US005927677A

United States Patent [19]

Speece et al.

[11] Patent Number: 5,927,677

[45] Date of Patent: Jul. 27, 1999

[54] SWIVEL POST ANCHOR

[75] Inventors: Stephen Speece, North Jackson; Kenneth Baker, Canfield, both of Ohio

[73] Assignee: The Steel City Corporation, Youngstown, Ohio

[21] Appl. No.: 09/007,628

[22] Filed: Jan. 20, 1998

Related U.S. Application Data

[63] Continuation-in-part of application No. 08/937,757, Sep. 25, 1997.

[51] Int. Cl.[6] ..... F16M 13/00

[52] U.S. Cl. ..... 248/516; 248/523; 248/530; 248/545; 52/165

[58] Field of Search ..... 248/516, 530, 248/545, 156, 288.51; 52/155, 165; 256/1

[56] References Cited

U.S. PATENT DOCUMENTS

| | | | |
|---|---|---|---|
| 430,827 | 6/1890 | Brower | 248/530 |
| 2,706,967 | 4/1955 | Iannetti . | |
| 3,204,898 | 9/1965 | Manning | 248/516 |
| 4,004,383 | 1/1977 | Watanabe | 52/165 X |
| 4,249,715 | 2/1981 | Repp . | |
| 4,588,157 | 5/1986 | Mills . | |
| 4,593,872 | 6/1986 | Svensson | 248/156 |
| 4,644,713 | 2/1987 | Lehman | 52/165 |
| 4,778,142 | 10/1988 | Roba . | |
| 4,863,137 | 9/1989 | Cockman et al. | 248/545 |
| 5,404,682 | 4/1995 | West | 52/165 |
| 5,695,166 | 12/1997 | Watts | 248/530 X |

*Primary Examiner*—Derek J. Berger
*Attorney, Agent, or Firm*—Harpman & Harpman

[57] ABSTRACT

A fence post anchor that adjusts for vertical post alignment by providing a post engagement support portion that swivels on a ground securing portion. The post engagement portion is defined by a split box sleeve secured to an adjustment dome. A fastener assembly interconnects the adjustment dome to the ground engagement portion that has multiple engagement flights on which the dome can be movably positioned and secured thereto.

6 Claims, 7 Drawing Sheets

SWIVEL POST ANCHOR

This is a continuation-in-part of Ser. No. 08/937,757, filed Sep. 25, 1997.

BACKGROUND OF THE INVENTION

1. Technical Field

This invention relates to post supporting devices that are driven vertically into the ground and to which an upstanding post is then secured. This device eliminates the need to dig fence or post holes in the ground in which posts are typically positioned and buried.

2. Description of Prior Art

Prior art devices of this type have relied on a variety of different designs which use a fixed ground engagement portion in the form of a spike or screw and a post bore ancillary engagement portion secured thereto. See U.S. Pat. Nos. 4,778,142, 4,588,157, 4,249,715 and 2,706,967.

In U.S. Pat. No. 2,706,967 an anchoring stake is disclosed having a ground engaging spike with a movable pin extending therefrom. The pin has a pivot ball on one end with a registering fitting secured to the spike. A lead ring is formed on the pin opposite end to which a pet lead can be attached.

U.S. Pat. No. 4,249,715 discloses a sign supporting apparatus having a ground engaging portion and an integral support post and end cap arm support from which a sign can be hung. The support post is slid up and down on the upstanding ground engagement portion of the device driving same downwardly into the ground. The end cap support arm for the sign is then inserted to the upstanding post portion.

U.S. Pat. No. 4,588,157 is directed to a post support having a ground engagement portion and an integral post receiving portion extending therefrom. The post receiving portion has a plurality of locking tabs within that wedgeably secure the post positioned within.

U.S. Pat. No. 4,778,142 shows an awning anchor having a ground engagement screw portion and a pivoted awning arm mount extending therefrom.

A prior art adjustable anchor post is described in German sales literature marked Exhibit A which discloses a post engagement portion having a contoured swivel base which is registerable on a secondary swivel base secured to a ground engagement portion. The two contoured surfaces are inter-engaged and held to one another by a pair of oppositely disposed fasteners extending through elongated slots in the respective base portion to allow for the angle orientation of the top portion.

SUMMARY OF THE INVENTION

An adjustable fence post anchor support having a ground engagement portion formed by a plurality of right angularly disposed tapered flights having contoured upper edge surfaces. A post support portion having an upstanding post engagement sleeve is secured to a contoured portion adjustably engageable over the flights. A fastener assembly threadably secures the post support portion to the ground engagement portion allowing full range of angular adjustment to be achieved after the ground engagement portion has been driven into the ground.

DESCRIPTION OF THE PREFERRED EMBODIMENT

Figure 1:
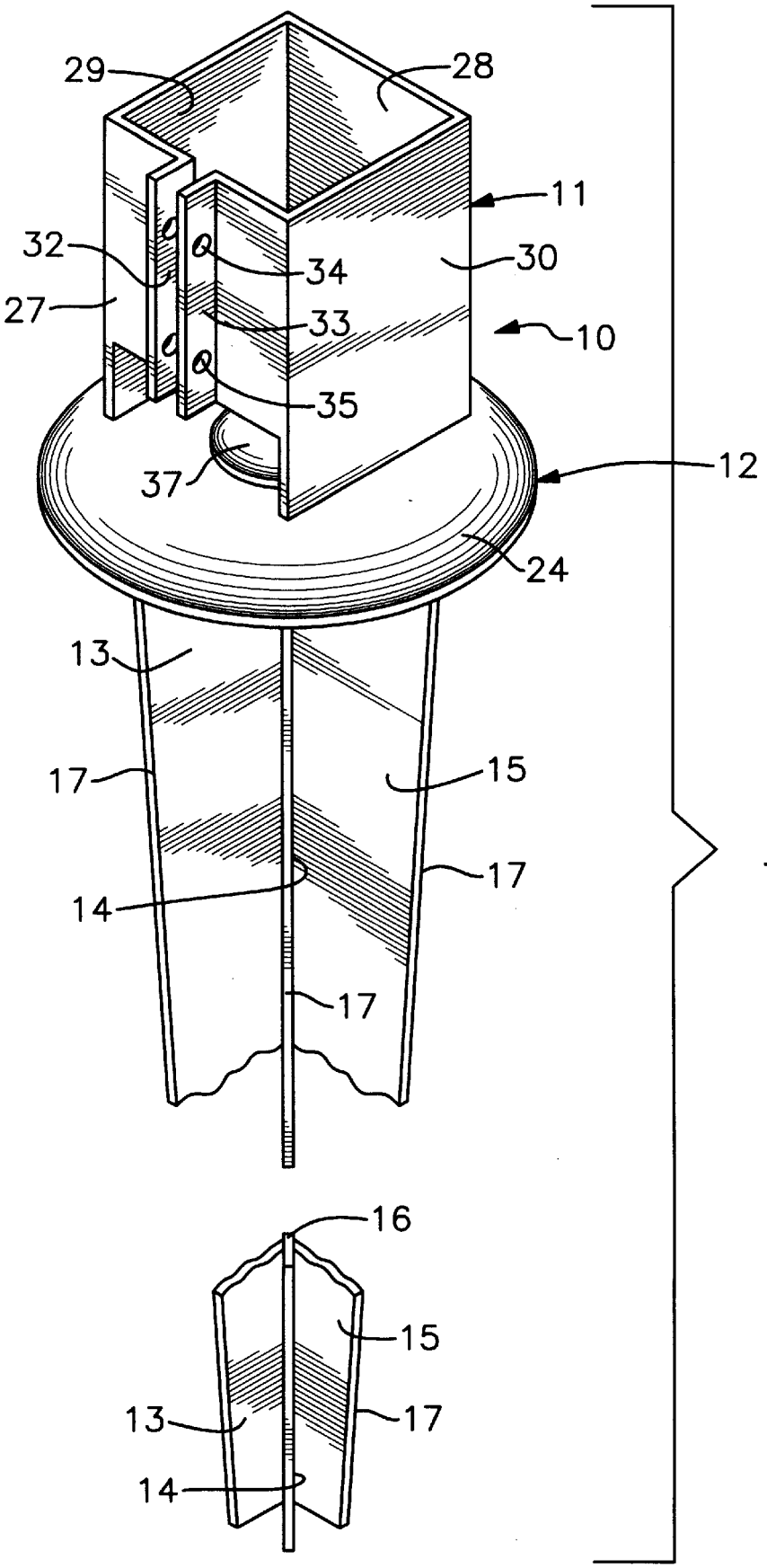
FIG. 1 is an illustrated perspective view of the adjustable anchor post of the invention.
Figure 2:
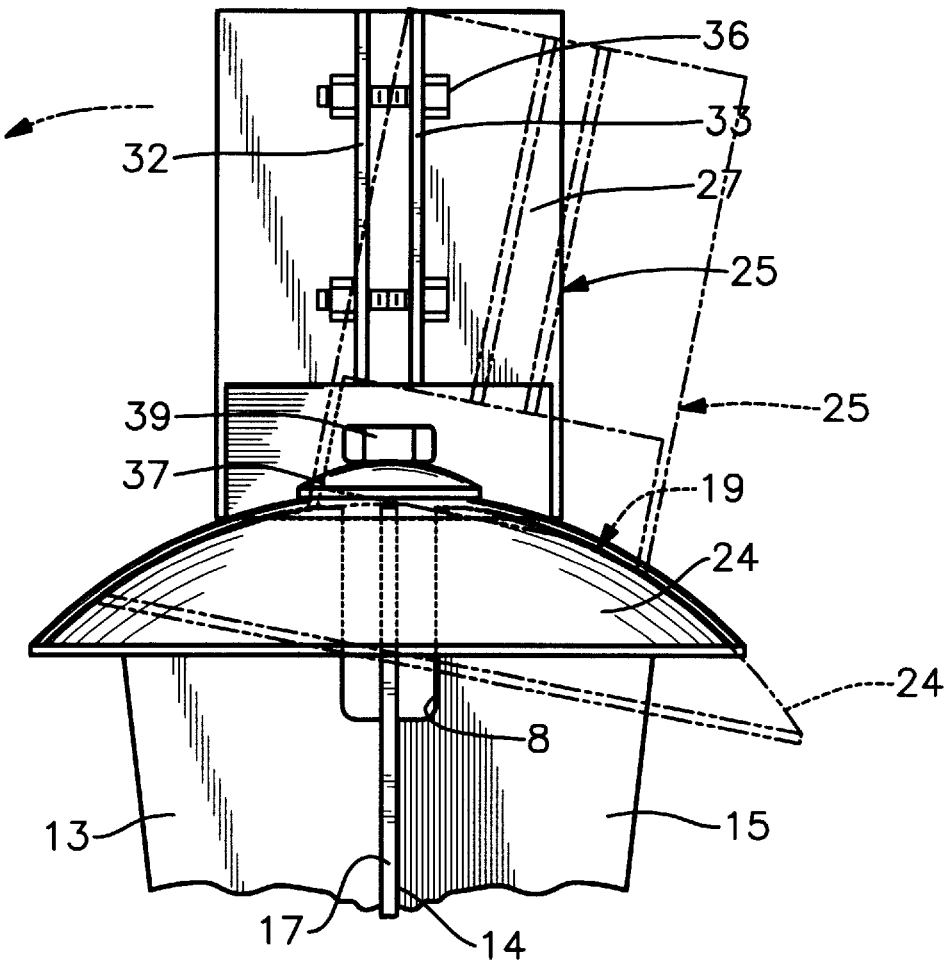
FIG. 2 is a partial side elevational view of the invention with portions shown in broken lines.
Figure 3:
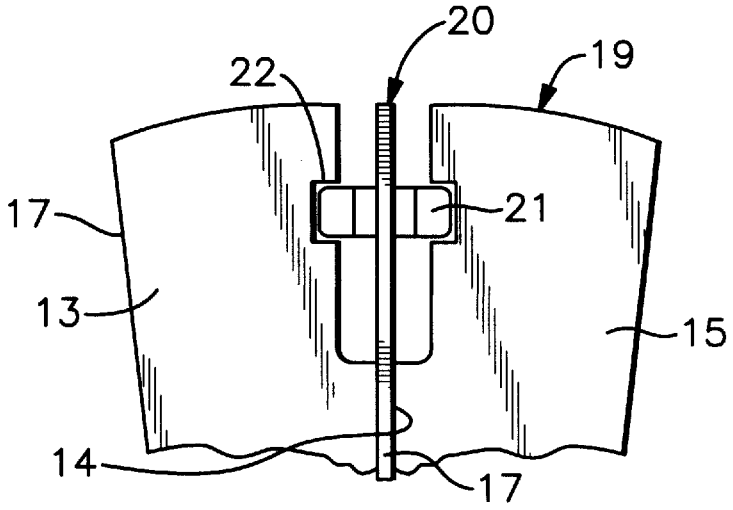
FIG. 3 is a partial side elevational view of the ground engagement portion.

Referring now to FIGS. 1–3 of the drawings, an adjustable post anchor 10 can be seen having a post support portion 11 and a ground engagement portion 12. The ground engagement portion 12 has a plurality of ground engagement flights 13, 14, 15, and 16 that are welded at W together in oppositely disposed effacing pairs. Each of the flights 13–16 are tapered along their respective outer edge portions 17. Each of the flights 13–16 have a curved upper edge at 18 that when in welded relationship as hereinbefore described define a pair of cross arcuate surfaces 19 and 20 therebetween, best seen in FIG. 3 of the drawings.

A threaded engagement element 21 is positioned in registering relationship within notches at 22 in recessed portions 23 of the respective flights 13–16.

Figure 4:
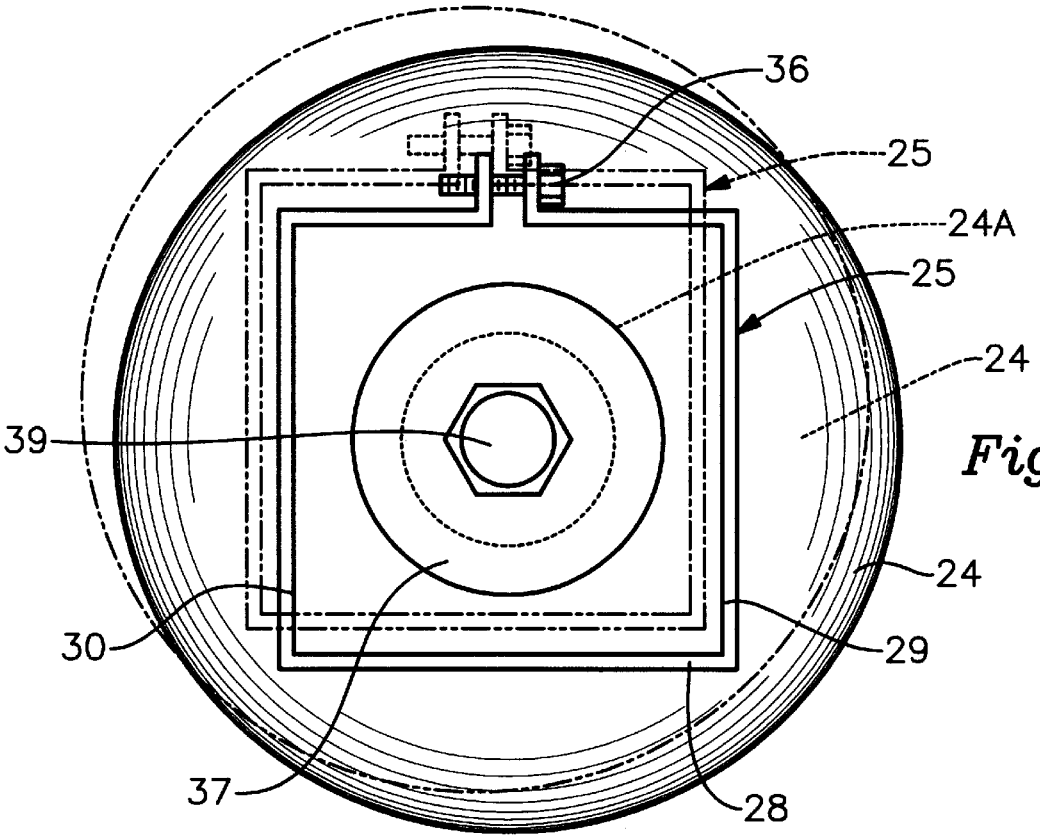
FIG. 4 is a top plan view with portions broken away illustrating the range of angular adjustment of the invention.
Figure 5:
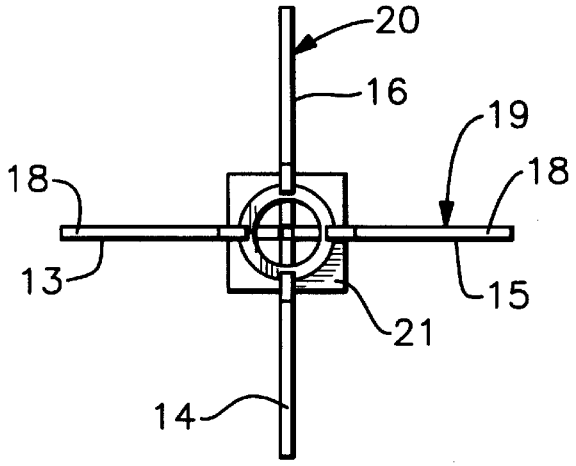
FIG. 5 is a top plan view of the ground engagement portion.
Figure 6:
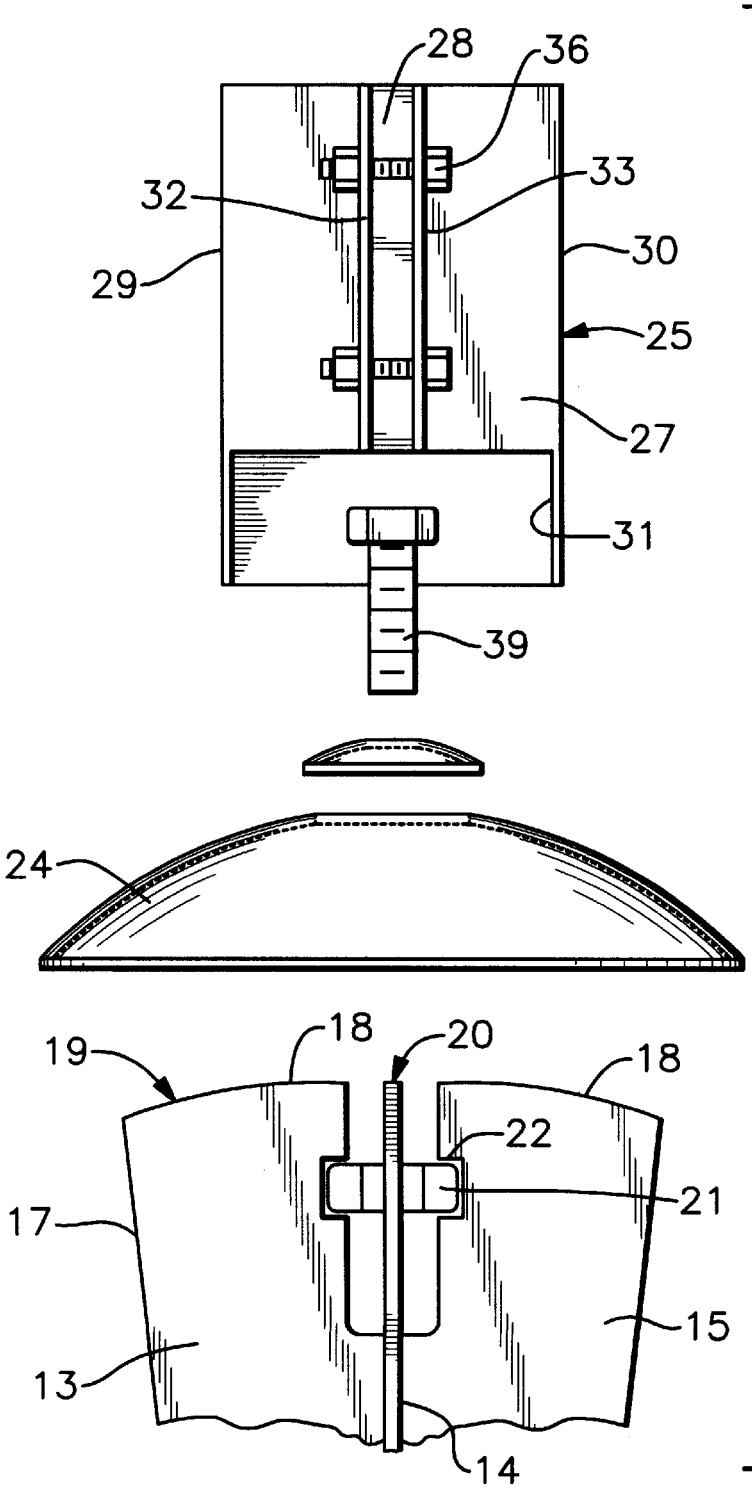
FIG. 6 is a side elevated exploded view of the invention.

Referring now to FIGS. 2, 4, and 6 of the drawings, the post engagement portion 11 can be seen having a cross-sectionally arcuate adjustment dome member 24 of a transverse dimension greater than that of the assembled flights 13–16 of the ground engagement portion 12. The dome 24 has a central opening therein at 24A. An upstanding split sleeve 25 is secured, by welding, to the dome 24 about the central opening at 24A. The sleeve 25 is cross-sectionally square having a front wall 27, a back wall 28 and oppositely disposed sidewalls 29 and 30. The front wall 27 has a notched access opening at 31 therein that extends from the dome member 24 and is split having a pair of horizontally spaced longitudinally extending parallel compression flanges 32 and 33 extending outwardly therefrom. The flanges 32 and 33 have longitudinally spaced apertures in aligned pairs at 34 and 35 with fastener assemblies 36 extending therethrough for compression of same holding a post, not shown, within the sleeve 25.

A contoured fixation disk 37 has a central aperture 38 therein through which extends a threaded fixation fastener 39, best seen in FIG. 6 of the drawings. The fixation disk 37 is positioned over the central opening at 24A in the dome 24 and is of a transverse dimension greater than that of said central opening 24 so as to overlie a portion of the dome member 24 extending thereabout. The fixation fastener 39 is threadable within the engagement element 21 hereinbefore described within the ground engagement portion 12.

In operation, as best seen in FIGS. 2 and 4 of the drawings, the post support portion 10 can be adjusted for vertical inclination relative to the ground engagement portion 12 as illustrated in broken lines in FIG. 4 of the drawings by sliding the dome 24 over and about the cross-arcuate surfaces 19 and 20 of the hereinbefore described flights 13–16. The relative amount of angular inclination achievable is limited by the engagement of the fixation fastener 39 within the center opening 24A of the dome 24 and the engagement of fixation disk 37 within the respective walls 28, 29 and 30 of the sleeve 25.

Once a desired angle has been achieved, normally a true vertical alignment of the post, not shown, within the post support portion 10, the fixation fastener 39 which is threadably within the engagement element 21 is rotated and tightened down against the fixation disk 39 securing same and the post support portion 10 to the ground engagement portion 12.

It will be evident from the above description that the ground engagement portion 12 with the adjustably attached post support portion 11 is driven down into the ground and secured within the post support portion and then the post, not shown, can be positioned vertically as desired by the adjustability of the contoured disk which is movably registerable on the ground engagement portion as hereinbefore described and then locked into place by tightening the fixation fastener 39 through the access opening 31 within the front wall 27 of the post engagement sleeve 25.

Figure 7:
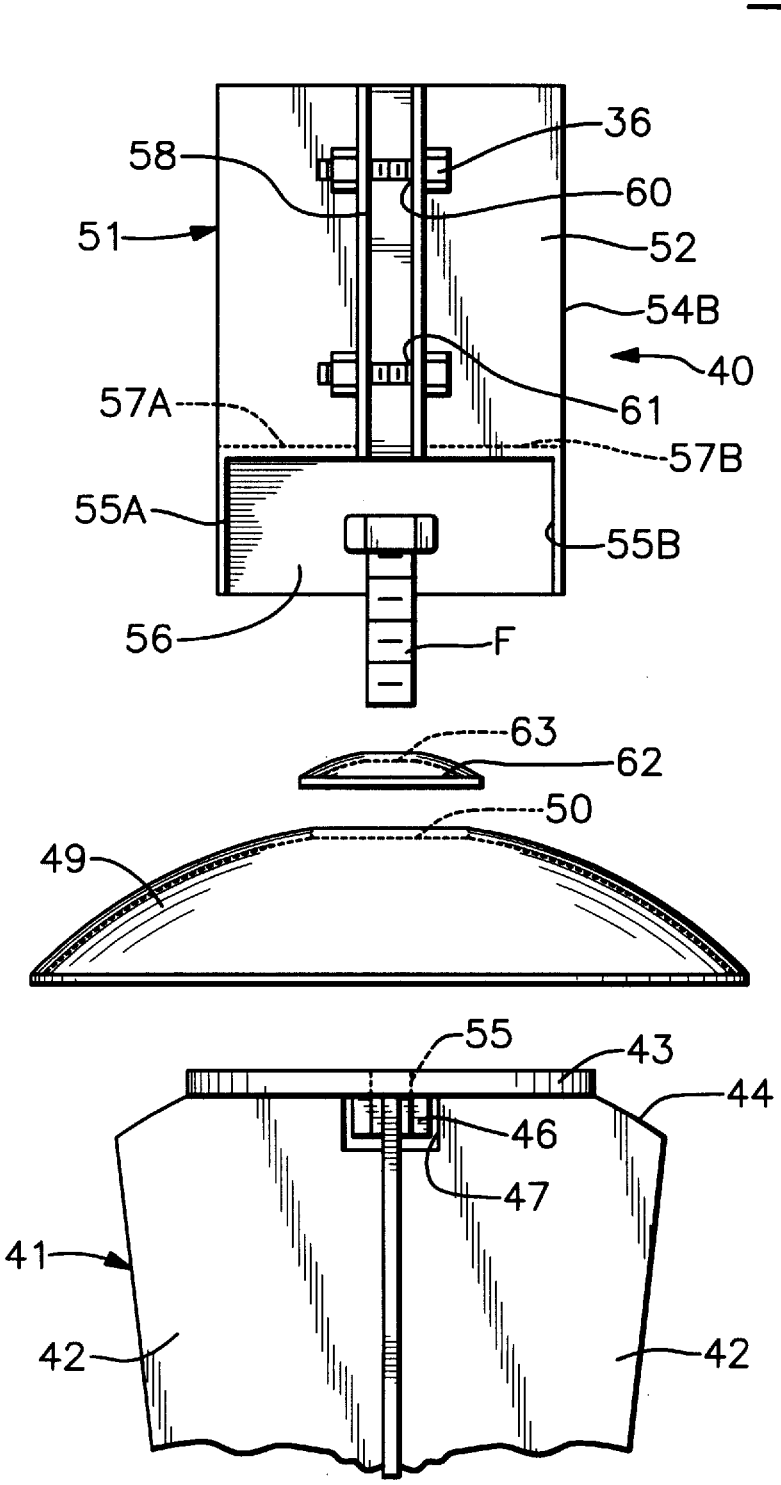
FIG. 7 is a front elevational exploded view of an alternate form of the invention.

Referring now to FIGS. 7–10 of the drawings, an alternate form of the invention can be seen of an adjustable post anchor 39 having a post engagement portion 40 and a ground securing portion 41. The ground securing portion 41 is similar to the hereinbefore described ground engagement portion 12 and accordingly has multiple tapered flights 42 secured together in oppositely disposed effacing pairs. A pivot plate 43 is secured to the flight's upper surfaces 44. The pivot plate 43 has a central aperture therein at 45 with a threaded nut 46 welded thereabout in a recess portion 47 of the flights 42, as best seen in FIG. 7 of the drawings. The pivot plate 43 is circular and spaced inwardly from the flight's perimeter longitudinal edges 48.

Figure 9:
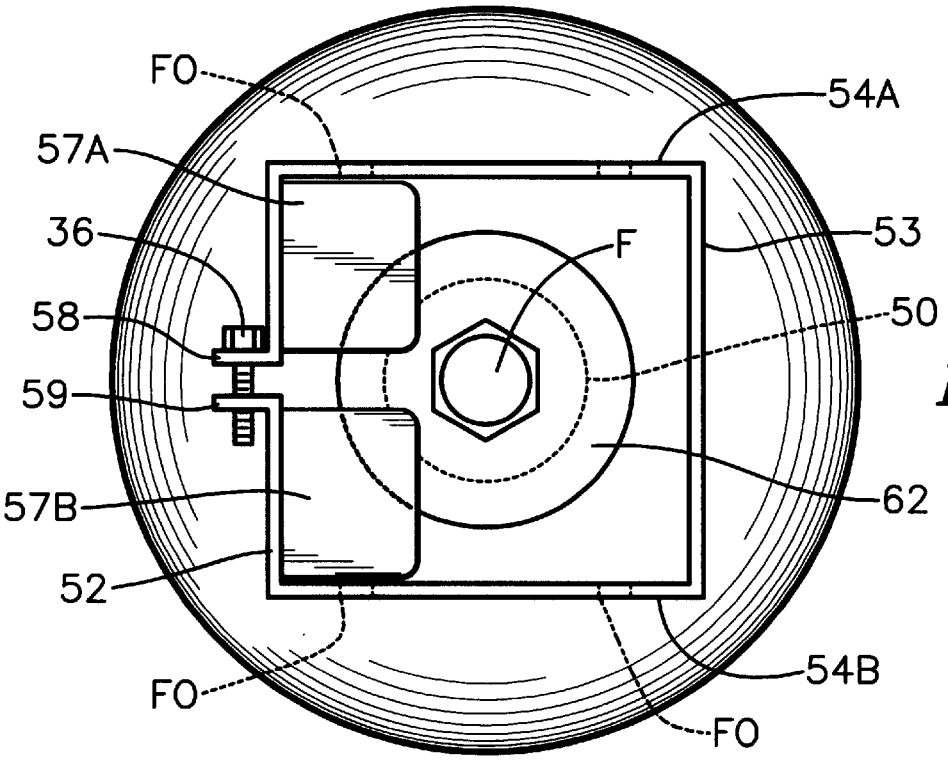
FIG. 9 is a top plan view of the alternate form of the invention.
Figure 10:
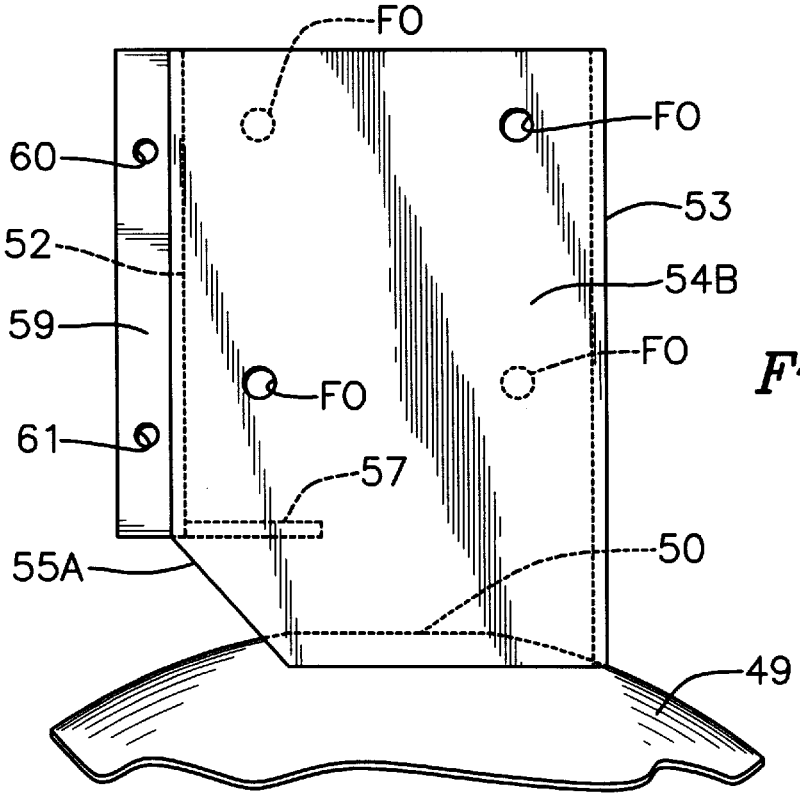
FIG. 10 is a partial side elevational view of the post engagement portion of the alternate form of the invention.

The post engagement portion 41 has a dome element 49 of a transverse dimension greater than that of the assembled flights 42 and corresponding pivot plate 43 as will be described in greater detail hereinafter. The dome 49 has a central opening at 50 with an upstanding post receiving sleeve 51 secured about the central opening 50 by welding. The post receiving sleeve 51 is characterized by a front wall 52, back wall 53 and oppositely disposed sidewalls 54A and B respectively. The sidewalls 54A and B are tapered inwardly at 55 and have pairs of oppositely disposed transversely aligned fixation openings FO therein as best seen in FIGS. 9 and 10 of the drawings. The front wall 52 has an access opening therein at 56 that extends to a transition point P of the sidewall tapered portions at 55A and B respectively.

A pair of post stop tabs 57 extend from the front wall 52 at the access opening 56 inwardly, overlying portions of the central aperture 50 as best seen in FIG. 9 of the drawings. A pair of horizontally spaced longitudinally extending parallel locking flanges 58 and 59 extend from a split S in the front wall 52 with longitudinally spaced apertures in aligned pairs therein at 60 and 61. Fasteners assemblies 30 extend registerably through said aligned pairs on oppositely disposed locking flanges as best seen in FIG. 7 of the drawings.

A contoured locking disk 62 having a central opening at 63 is positioned over the central opening 50 in the dome 49 and is of a diameter greater than that of said central opening 50 so as to be engageable thereon. A threaded fastener F extends through the contoured locking disk 62 and is registerable within the threaded nut 46 on the pivot plate 43 as hereinbefore described and as best seen in FIG. 8 of the drawings which also illustrates the operation of same.

Figure 8:
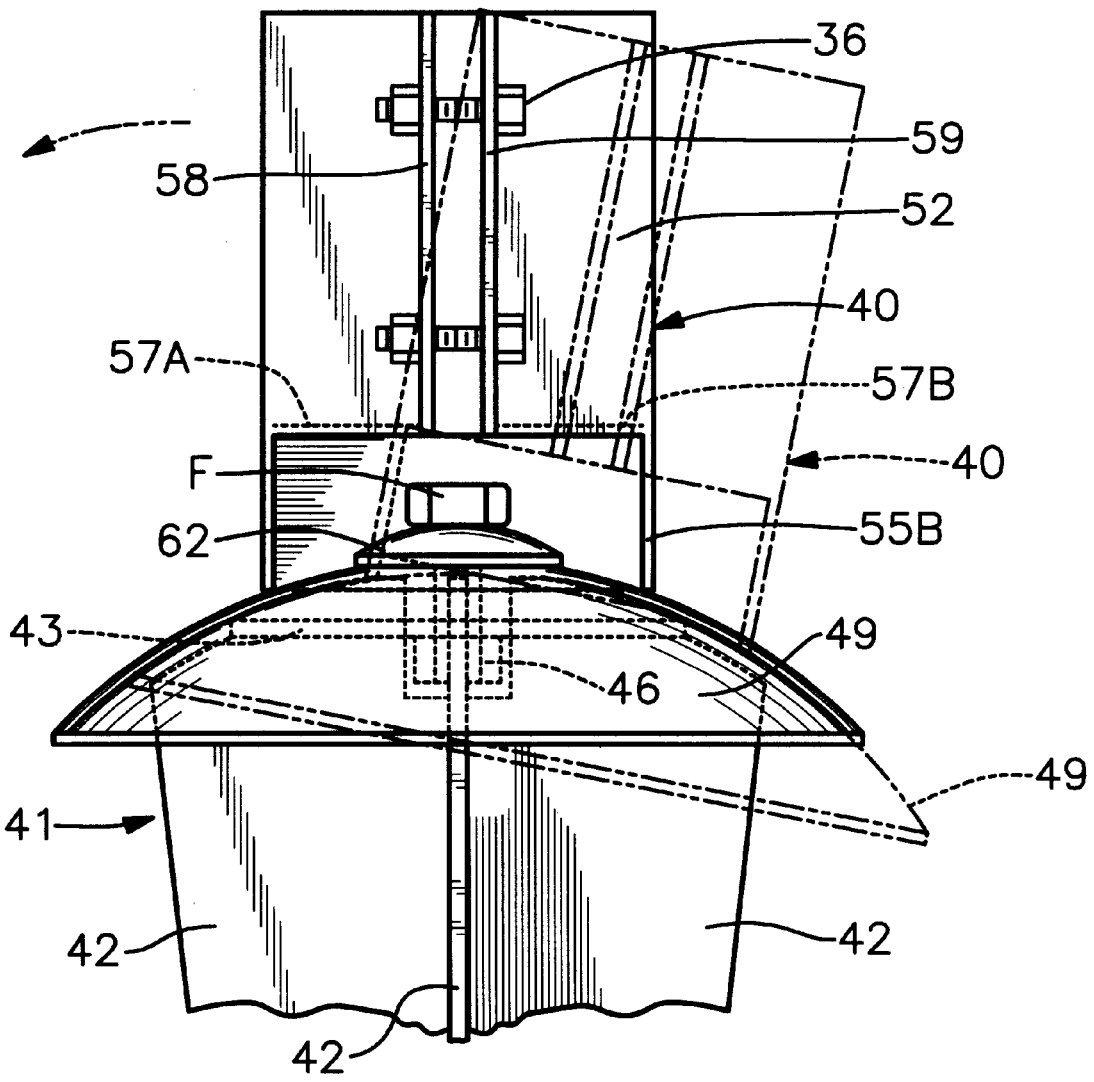
FIG. 8 is a partial side elevational view of the alternate invention with portions shown in broken lines.

It will be apparent that by loosening the fastener F, the dome 49 and attached upstanding sleeve 51 can be adjustably positioned from its vertical axis as illustrated in FIG. 8 with the dome 49 engageable on the pivot disk 43 giving a full range of angular adjustable inclination to the device.

The operation of the adjustable post anchor 39 is similar to that of the hereinbefore disclosed post anchor 10 in that the ground securing portion 41 is driven into the ground and the post engagement portion is then adjustably secured therethrough by the threaded fastener F.

It will therefore be evident that the post engagement portion 40 can be adjusted on its vertical axis on the ground securing portion 41, as noted above, by registration of the pivot plate 43 within the dome 49 allowing for a wide range of vertical angular adjustment thereto as set forth in the preferred form of the invention hereinbefore illustrated and described.

It will thus be seen that a new and novel adjustable fence post anchor has been illustrated and described and it will be apparent to those skilled in the art that various changes and modifications may be made therein without departing from the spirit of the invention, therefore I claim:

1. An adjustable post support for securing a post in the ground in a vertical upright position comprises: a post supporting portion, and a ground engagement portion, said post supporting portion comprises an upstanding split sleeve, a contoured dome secured to one end of said sleeve, said dome having a central aperture within, means for securing said post within said sleeve, an apertured fixation element registerable on said dome, a fixation fastener engageable on and through said apertured fixation element and said dome, said ground engagement portion comprises a plurality of upstanding vertically elongated tapered flights secured to one another to be vertically driven into the ground, a pivot plate secured to said flights, said pivot plate having a flat upper engagement surface with a perimeter edge engageable within said dome, means for threadably securing said fixation fastener to said pivot plate, and post stop tabs extending within said sleeve in spaced relation to said fixation fastener.

2. The adjustable post support set forth in claim 1 wherein said means for securing said post within said sleeve comprises: a pair of elongated spaced parallel flanges extending from said split sleeve defining said split within said sleeve, and fasteners registerably engaged through aligned apertures in said respective flanges for compression of said sleeve.

3. The adjustable post set forth in claim 1 wherein said means for threadably securing said fixation fastener to said pivot plate comprises: a threaded engagement element secured to said pivot plate.

4. The adjustable post support set forth in claim 1 wherein said pivot plate is of a known transverse dimension less than a transverse dimension of said elongated tapered flights.

5. The adjustable post support set forth in claim 1 wherein said upstanding sleeve has an access opening therein.

6. The adjustable post set forth in claim 1 wherein said post engagement portion and said ground securing portion are made of metal.

* * * * *